US009388018B2

(12) United States Patent
Van Der Meijden et al.

(10) Patent No.: US 9,388,018 B2
(45) Date of Patent: Jul. 12, 2016

(54) SUPPLY OF ROPE TO AN ELEVATOR SPEED LIMITER

(75) Inventors: Gert Van Der Meijden, Otterlo (NL); Jos Van Den Heuvel, 'S-Hertogenbosch (NL)

(73) Assignee: KONE CORPORATION, Helsinki (FI)

( * ) Notice: Subject to any disclaimer, the term of this patent is extended or adjusted under 35 U.S.C. 154(b) by 2111 days.

(21) Appl. No.: 12/493,011

(22) Filed: Jun. 26, 2009

(65) Prior Publication Data

US 2009/0260926 A1 Oct. 22, 2009

Related U.S. Application Data

(63) Continuation of application No. PCT/FI2007/000280, filed on Nov. 28, 2007.

(30) Foreign Application Priority Data

Dec. 27, 2006 (FI) ..... 20061157

(51) Int. Cl.
*B66B 19/02* (2006.01)
*B66B 5/04* (2006.01)
*B66B 9/187* (2006.01)

(52) U.S. Cl.
CPC ..... *B66B 5/044* (2013.01); *B66B 19/02* (2013.01); *B66B 5/042* (2013.01); *B66B 9/187* (2013.01)

(58) Field of Classification Search
CPC ..... B66B 19/02; B66B 5/042; B66B 5/044; B66B 5/04; B66B 9/187
USPC ..... 187/305, 350, 373, 414, 900; 242/365.4, 365.9, 390.3
See application file for complete search history.

(56) References Cited

U.S. PATENT DOCUMENTS

| | | | | | |
|---|---|---|---|---|---|
| 2,298,167 | A | * | 10/1942 | Rissler | 187/352 |
| 3,141,630 | A | * | 7/1964 | Eitel | 242/390.9 |
| 3,519,101 | A | | 7/1970 | Sieffert | |
| 4,015,795 | A | * | 4/1977 | Chong | 242/597.7 |
| 5,033,586 | A | * | 7/1991 | Richards et al. | 187/259 |

FOREIGN PATENT DOCUMENTS

| | | | | | |
|---|---|---|---|---|---|
| EP | 0 670 282 | A2 | | 9/1995 | |
| JP | 10-182030 | A | | 7/1998 | |
| JP | 2005213037 | A | * | 8/2005 | B66B 5/04 |
| WO | WO-01/64572 | A1 | | 9/2001 | |

* cited by examiner

*Primary Examiner* — William A Rivera
*Assistant Examiner* — Stefan Kruer
(74) *Attorney, Agent, or Firm* — Birch, Stewart, Kolasch & Birch, LLP

(57) ABSTRACT

The invention concerns an arrangement in the supply of rope to the speed limiter of an elevator. The arrangement comprises at least a braking device for braking the rope being supplied to the speed limiter. As new rope is being fed to the speed limiter, the new rope has been fitted to run via the braking device and under a diverting pulley in the lower part of the elevator shaft and passed further from the diverting pulley over an upper speed limiter pulley to act on the safety gear of the elevator.

9 Claims, 4 Drawing Sheets

SUPPLY OF ROPE TO AN ELEVATOR SPEED LIMITER

Figure 1:
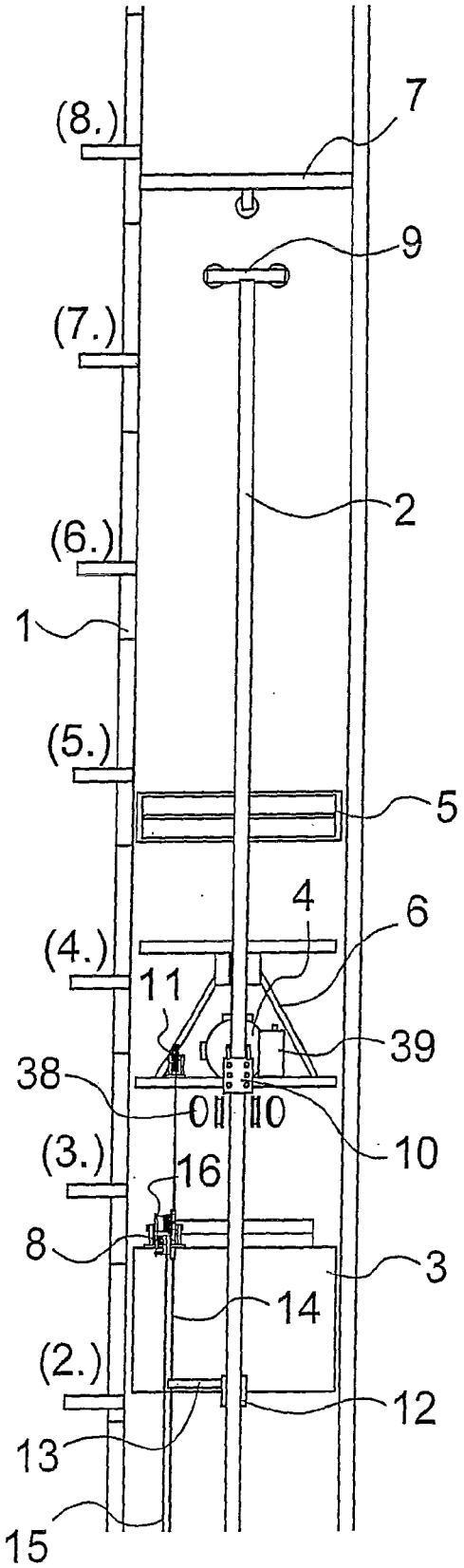

This application is a Continuation of co-pending Application No. PCT/FI2007/000280 filed on Nov. 28, 2007, and for which priority is claimed under 35 U.S.C. §120; and this application claims priority of Application No. FI 20061157 filed in Finland on Dec. 27, 2006 under 35 U.S.C. §119; the entire contents of all are hereby incorporated by reference.

The present invention relates to an arrangement in the supply of rope to the speed limiter of an elevator as defined in the preamble of claim 1, especially when the elevator is being installed during construction of a building.

During the construction stage of high-rise buildings, there is often a need to use an elevator before the building has been completed. Elevators are needed for many purposes during the construction stage. For example, in construction-time use they are needed for the transportation of construction workers, so it would be desirable for the construction workers to be able to move safely and quickly as high up in the building as possible as new floors are completed. Therefore, the elevators should be able to reach as high floors in the building as possible as construction of the building is advancing, and the higher floors the elevator is able to serve, the better. Moreover, in high-rise buildings the lower floors are generally completed and ready for normal use before the higher floors are finished. Therefore, the elevators are required to be able to serve the already completed floors in as normal a manner as possible, even if the higher floors of the building are still under construction.

During the construction time, construction workers and building materials can be transported by means of separately installed construction elevators mounted e.g. on the façade of the building, which are dismantled after the building has been completed. Such solutions involve the problems of installation and high cost of the extra elevators and the expenses resulting from the dismantling. A further problem is that this type of construction elevators can not provide normal elevator service to the completed lower floors of the building.

In prior art, to address this problem, a so-called jump elevator has been developed for construction-time use. In such a solution, the final elevator shafts are built to their completed form in connection with the erection of the building and at least some of the elevator shafts are provided with a temporary machine room with an elevator car attached to it. At certain stages of construction, when a suitable number of new floors have been completed, a so-called jump-lift is performed, whereby the temporary elevator machine room is moved higher up by the distance allowed by the number of new floors. Thus, the hoisting height of the elevator is increased by this number of floors. At the same time, all the required elevator components are extended to a level corresponding to the new height to enable the elevator to serve the new height level in the normal manner.

One of the problems about the above-mentioned construction-time elevator operation is how to use the speed limiter in as normal and safe a manner as possible both during the jump-lift and in the period between jump-lifts when the elevator serves the lower floors of the building in the normal way. During the jump-lift, the length of the speed limiter rope needs to be increased at the same time to allow the speed limiter, placed e.g. in a temporary machine room, to be moved upwards with the machine room by a distance corresponding to the jump-lift. Despite the increase in the rope length, the speed limiter must function normally during the jump-lift and it has to be able to stop the elevator car on the safety gear if the car falls rapidly downwards. According to prior art, temporary other safety solutions have been used during the jump-lift, and after the jump-lift the speed limiter has had to be installed each time again in its new placement. Carried out in this way, the installation work is slow and expensive and, due to the many installation operations, also increases installation errors and consequently the safety risk.

The object of the present invention is to overcome the above-mentioned drawbacks and to produce a reliable and safe arrangement wherein the final speed limiter of the elevator can be effectively used already during construction-time elevator operation. To accomplish this aim, the object of the invention is to achieve a reliable, simple, economical and effective arrangement in the supply of rope to the speed limiter of an elevator, particularly when an elevator is installed during the construction of a building, an arrangement that also allows faster installation. A further object of the invention is, as the construction is advancing, to maximize the number of served floors as quickly as possible upon the completion of new floors. The arrangement of the invention is characterized by what is disclosed in the characterizing part of claim 1. Correspondingly, other embodiments of the invention are characterized by what is disclosed in the other claims.

The invention concerns an arrangement in the supply of rope to the speed limiter of an elevator, said elevator comprising at least a hoisting machine and an elevator car suspended to be supported by the hoisting machine and fitted to move along guide rails in an elevator shaft, and said speed limiter comprising at least an upper rope pulley placed essentially in conjunction with the speed limiter, over which pulley the speed limiter rope has been fitted to run, and a diverting pulley which is placed essentially in the lower part of the shaft and under which the speed limiter rope has been fitted to run, and a safety gear, to which the rope is secured. The arrangement of the invention is characterized in that the arrangement comprises at least a braking device for braking the rope supplied to the speed limiter, said device being fitted to maintain a sufficient tension of at least the rope portion running over the rope pulley to permit gripping during the supply of new rope.

An arrangement according to a preferred embodiment of the invention is characterized in that, when new rope is being supplied to the speed limiter, the new rope is fitted to run via the braking device and under the diverting pulley in the lower part of the elevator shaft and passed further from the diverting pulley over the upper speed limiter pulley to act on the safety gear of the elevator.

An arrangement according to a second preferred embodiment of the invention is characterized in that the arrangement comprises a rope feed device, on which the braking device is disposed and which rope feed device has been fitted to be movable with the elevator car.

An arrangement according to a third preferred embodiment of the invention is characterized in that the braking device has tensioning elements provided with adjustment of compressive force and arranged to maintain a desired tension of the new rope passing through the braking device.

An arrangement according to yet another embodiment of the invention is characterized in that the braking device has locking elements for locking the new rope so as to keep it immovable relative to the braking device during normal operation of the elevator.

An arrangement according to yet another embodiment of the invention is characterized in that the rope feed device comprises a lever arm hinged to be movable in a vertical plane, to the free end of which are fastened both the first end of the rope coming from the upper rope pulley of the speed limiter and the rope going from the rope feed device to the safety gear.

An arrangement according to yet another embodiment of the invention is characterized in that the braking device has at least two mutually parallel braking plates having vertical grooves in the middle of their side surfaces, said grooves being fitted opposite to each other in the braking device, and the new rope has been fitted to run in the space formed by the grooves to allow it to pass through the braking device.

An arrangement according to yet another embodiment of the invention is characterized in that the braking plates are provided with grooves of mutually different sizes so that each braking plate has one groove on either side and that the two grooves on the same braking plate are of mutually different sizes.

An arrangement according to yet another embodiment of the invention is characterized in that it has been adapted to supply new rope to the speed limiter by raising the elevator car upwards.

An arrangement according to yet another embodiment of the invention is characterized in that it has been adapted to supply new rope during a jump-lift from a reel placed on the elevator car so that the new rope going through the rope feed device is passed through the braking device, in which braking device the tension of the rope has been adjusted to be such that the friction on the upper rope pulley of the speed limiter is sufficient to activate the safety gear if necessary even during a jump-lift.

Inventive embodiments are also presented in the description part and drawings of this application. The inventive content disclosed in the application can also be defined in other ways than is done in the claims below. The inventive content may also consist of several separate inventions, especially if the invention is considered in the light of explicit or implicit sub-tasks or with respect to advantages or sets of advantages achieved. In this case, some of the attributes contained in the claims below may be superfluous from the point of view of separate inventive concepts. Similarly, different details described in connection with each embodiment example of the invention can also be applied in conjunction with other embodiment examples.

The solution of the invention provides the advantage of a simple and economical arrangement enabling fast and safe installation and commissioning of the speed limiter. Thus, the invention makes it possible to achieve e.g. the advantage that the speed limiter to be used in the final completed elevator can already be used during installation time during a jump-lift as well, so that the speed limiter is able to stop the elevator car on the safety gear during the jump-lift even though new speed limiter rope is simultaneously being supplied to the speed limiter. A further advantage is an improvement of safety of installation and safety of construction-time normal operation, because a conventional speed limiter to be used in the final completed elevator can be used during construction time. Since the speed limiter is in use during the entire installation period, this also accelerates the installation of the elevator, so the elevator installation work progresses fast with the progress of construction. Therefore, the higher floors become quickly accessible and the completed floors are provided normal elevator service soon after their completion. This solution also saves time for the construction workers and thus accelerates the completion of the building.

Figure 2:
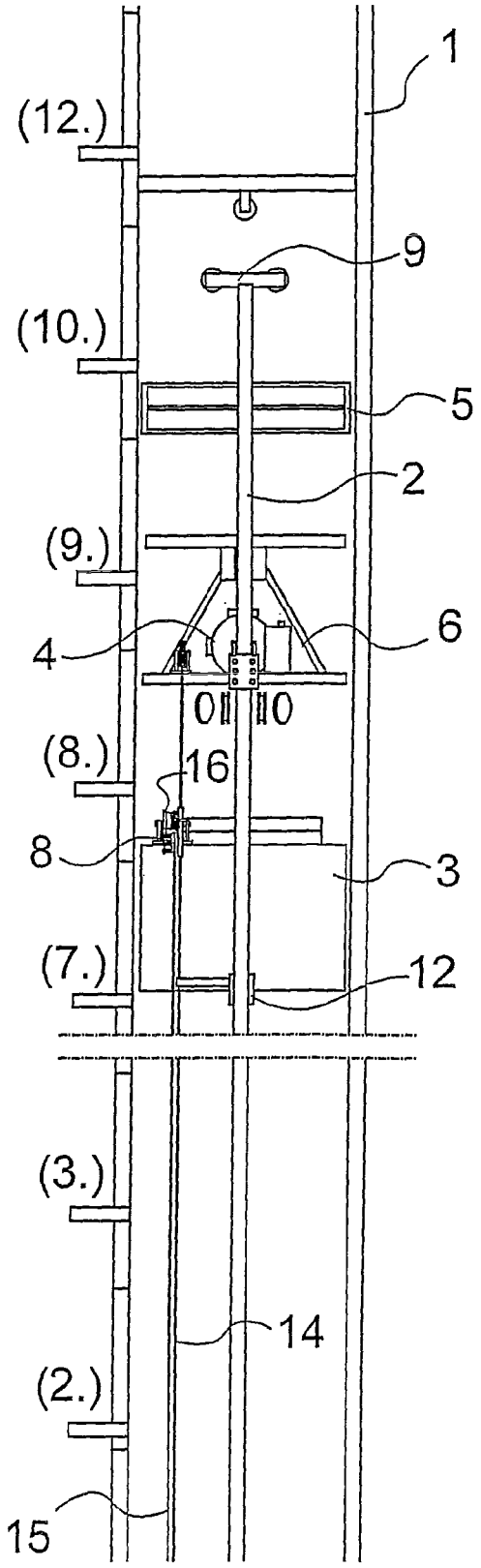
Figure 3:
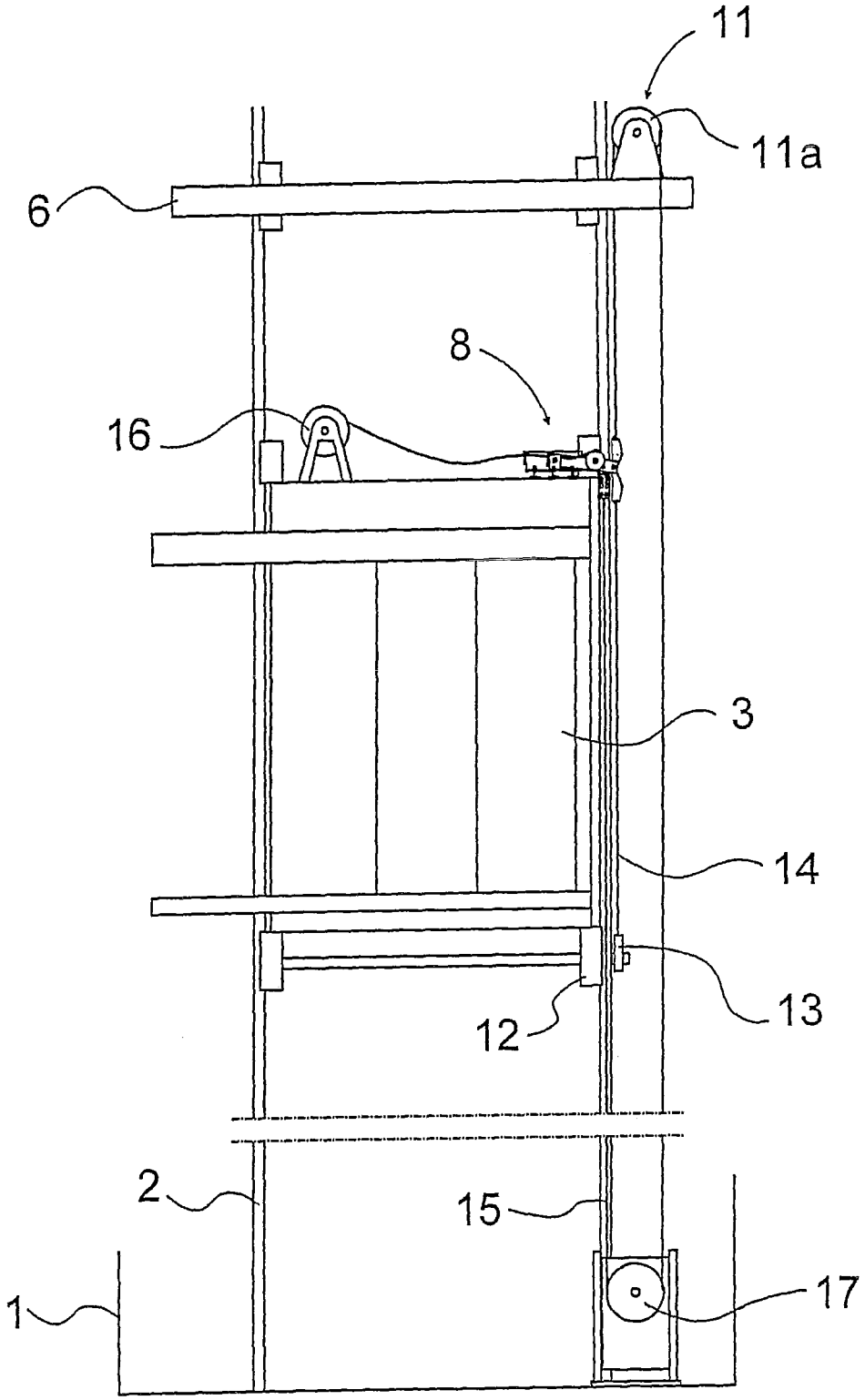
Figure 6:
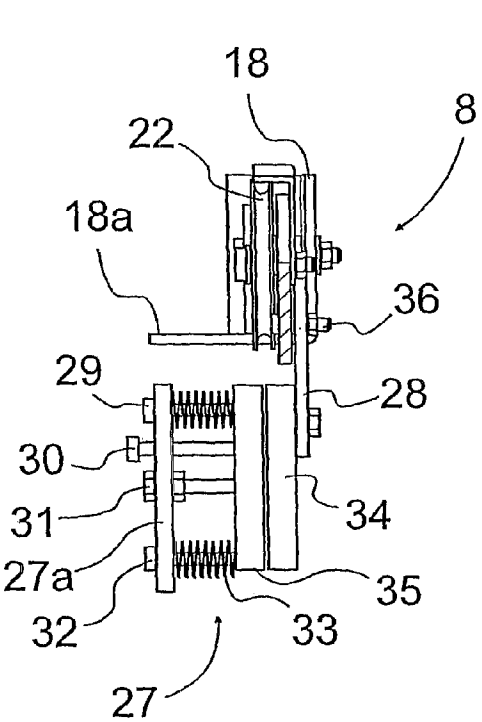
Figure 4:
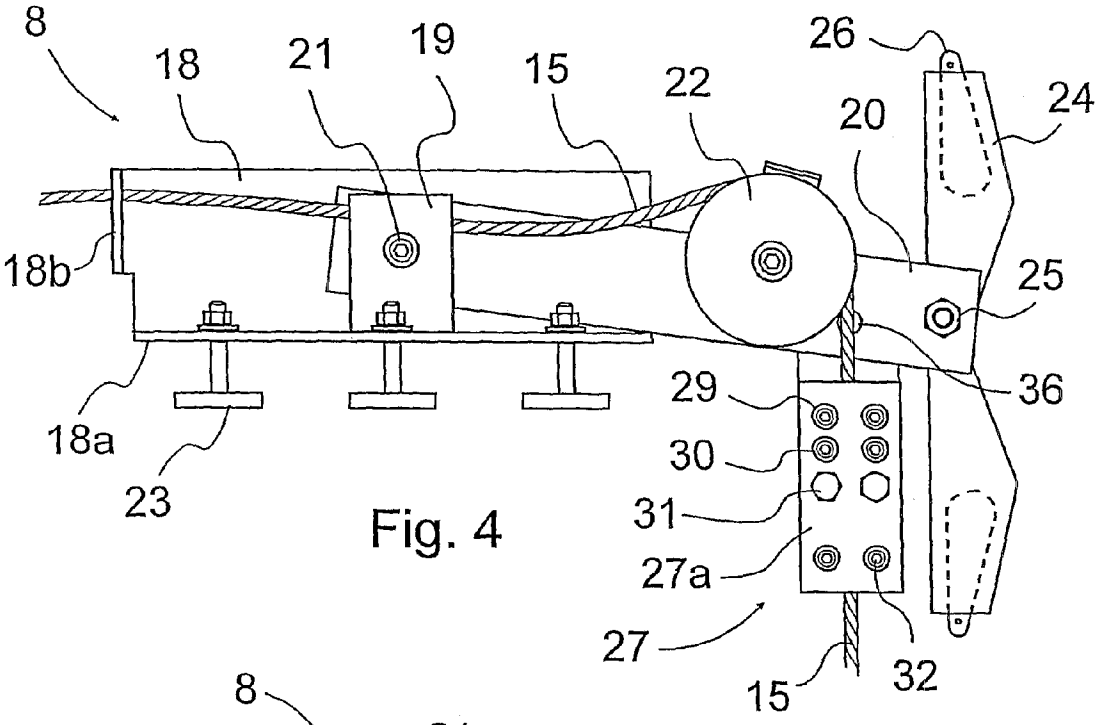
Figure 5:
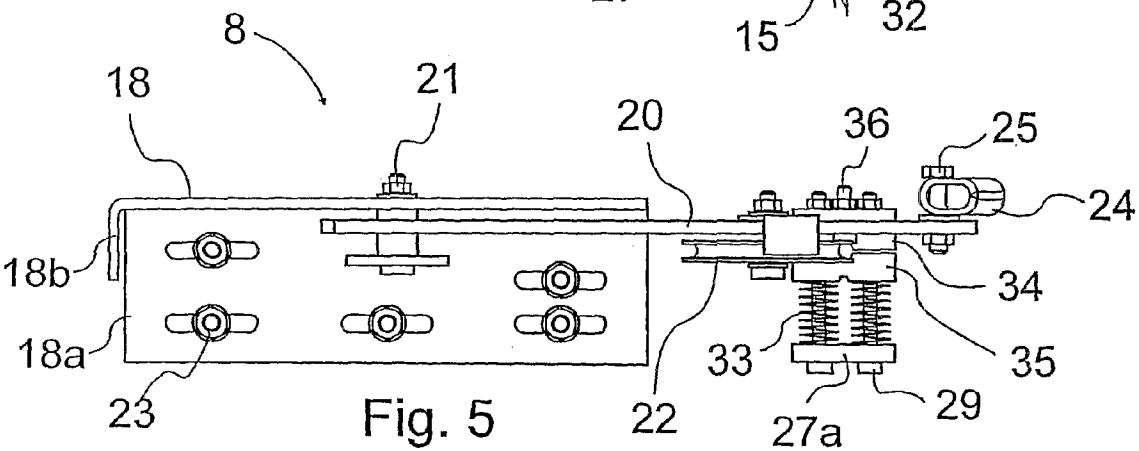

In the following, the invention will be described in greater detail by referring to an embodiment example and the attached drawings, wherein FIG. 1 presents a simplified and diagrammatic side view of an installation situation according to the invention where an elevator car has already been installed in an elevator shaft, FIG. 2 presents a simplified and diagrammatic side view of an installation situation according to the invention where a first jump-lift has been carried out, FIG. 3 presents a simplified and diagrammatic front view of a speed limiter arrangement according to the invention in an elevator shaft, FIG. 4 presents a side view of a detail concerning rope supply in an arrangement according to the invention, FIG. 5 presents a top view of the detail according to FIG. 4, FIG. 6 presents a front view sectioned along line A-A in FIG. 4, and FIGS. 7-9 present simplified and diagrammatic top views of different structural alternatives for accommodating speed limiter ropes of different thicknesses in the arrangement of the invention.

FIG. 1 presents a simplified and diagrammatic side view of an arrangement according to the invention in a situation where at least the lowest guide rails 2, a working platform 5, a hoisting support 7 mounted for raising the working platform, a temporary machine room 6 and an elevator car 3 provided with at least a safety gear 12 as well as a speed limiter 11 with the associated ropes 14, 14 and rope feed device 8 have already been installed in an elevator shaft 1.

At the start of installation, an installation-time working platform 5 placed in the shaft 1 and movable in the vertical direction is suspended on the hoisting support 7 by means of e.g. a Tirak hoist, a hoisting rope and a diverting pulley provided on the hoisting support 7. For the sake of clarity, the hoisting rope of the working platform 5 is not depicted in the figures. By using the working platform 5, at least the lower parts of the elevator guide rails 2 have been mounted in the shaft 1, which guide rails 2 are extended to a suitable height below the hoisting support 7. Besides the guide rails, substantially all the components and devices, such as e.g. electric equipment and landing doors, that are needed in the shaft and at the landings are installed at the same time substantially up to the height of the guide rails.

Likewise, a temporary machine room 6, which is of a design allowing e.g. easy assembly, disassembly after installation and reuse at a new installation site, is placed in the shaft 1 at the initial stage of installation. The temporary machine room 6 comprises at least a frame structure, which is provided with guides fitted to move along the elevator guide rails 2 in the same way as the guides of the elevator car. In addition, the temporary machine room 6 is provided with a safety gear, which works substantially in the same way as the safety gear of the elevator car and, in an emergency situation, prevents the machine room from falling too far downwards. The temporary machine room 6 also carries an elevator hoisting machine 4 including at least a traction sheave, a diverting pulley and a control unit.

The temporary machine room 6 is further provided with at least diverting pulleys 38 and a machine room hoisting device, such as a Tirak hoist 39, which is secured to the frame structure of the temporary machine room 6 and serves to suspend the machine room on a hoisting rope and to move it in the vertical direction. The machine room hoisting rope, which is not shown in the figures for the sake of clarity, has been fitted to run from the Tirak hoist 39 over diverting pulleys placed e.g. at the ends of supporting members 9 mounted on the upper ends of the guide rails 2 and then down around the diverting pulleys 38 below the machine room and after these back to the Tirak hoist 39, the hoisting rope thus forming a multiple closed loop. In this way, the vertical forces produced by the temporary machine room 6 and the elevator car 3 are transmitted to the bottom structures of the building substantially via the guide rails 2 already secured. Constructed like this, the temporary machine room 6 is self-lifting. The temporary machine room 6 is additionally provided with a locking mechanism adapted to get locked on a locking plate 10, which is fastened to the guide rail 2 at a suitable height when a jump-lift is to be carried out.

The speed limiter 11, which also serves e.g. as the final speed limiter of the elevator, is secured to the structures of the temporary machine room 6 for the installation period. The speed limiter rope 14 running over the upper diverting pulley 11*a* of the speed limiter is passed via a safety gear lever 13 to activate the safety gear 12 of the elevator car 3 when necessary. In a gripping situation, the wedges of the safety gear stop the downward motion of the elevator car. Correspondingly, the rope feed device 8 supplying new rope 5 to the speed limiter 11 is mounted e.g. on the top of the elevator car 3. The feed device 8 has been designed to deliver new rope 15 for use by the speed limiter 11 from a reel 16 placed on the top of the elevator car, suitably e.g. during a jump-lift, because the speed limiter rises permanently to a higher level during a jump-lift.

FIG. 2 illustrates the elevator installation in a situation where a first jump-lift has been carried out and the elevator car 3 has been lifted from the second floor to the seventh floor. The length of the rope 14 of the speed limiter 11 has now been increased by an amount substantially equal to twice the distance of the jump-lift carried out, and the speed limiter 11 is fully functional in the temporary machine room 6 at the new floor level.

FIG. 3 presents a more detailed illustration of how the feed device 8 for supplying new rope 15 to the speed limiter 11 is disposed on the elevator car 3. The feed device 8 is placed e.g. on the top of the elevator car 3, at the edge adjacent to the speed limiter rope 14. In addition, placed on the top of the car 3 is a reel 16 from which the new rope 15 is taken to the feed device 8. The new rope 15 delivered from the reel 16 is passed via the feed device 8 and under the lower diverting pulley 17 of the speed limiter in the lower part of the elevator shaft 1 and, after passing around this diverting pulley 17 by the lower side, further upwards over the rope pulley 11*a* of the speed limiter 11 on the temporary machine room 6. Having passed around this pulley by the upper side, the rope 15 is passed downwards to the rope feed device 8, to which the free end of the rope 15 is secured. From the feed device 8, a rope 14 of essentially unchanged length is further passed downwards to the lever 13 of the elevator safety gear 12, to which lever the free end of the rope 14 is secured.

FIGS. 4-6 present a more detailed illustration of the feed device 8 for supplying new rope 15 to the speed limiter. The feed device 8 comprises at least a frame 18, which is secured by fastening elements 23 e.g. to the ceiling structures of the upper part of the elevator car 3. The frame 18 itself has been made e.g. by bending from metal plate in such manner that the frame has an L-shaped profile as seen from the end, comprising at least a substantially vertical part 18 and a horizontal part 18*a*. In addition, the frame has at its first end a bend forming a partial back wall 18*b* bent to a substantially straight angle relative to the vertical wall of the frame 18. The back wall 18*b* is provided with a hole for lead-through of the new rope 15.

A lever arm 20 is pivotally joined at its first end to the frame 18 by means of a hinge 21 and a support plate 19 secured to the lower part 18*a* of the frame 18, the lever being fitted to be turnable in an essentially vertical plane. Rotatably mounted near the second end of the lever arm 20 is a guide wheel 22 for guiding the new rope 15, fitted to be rotatable in a substantially vertical plane. In addition, secured by a fastening element 25 to the second end of the lever arm 20 is a double-ended rope terminating member 24, to the upper part of which is secured by means of a wedge 26 the first end of the rope 15 coming downwards from the upper rope pulley 11*a* of the speed limiter 11 and to the lower part of which is correspondingly secured by means of a second wedge 26 the rope 14 going downwards to the lever 13 of the safety gear 12. Thus, the lever arm 20 of the feed device 8 is connected by one end to the lever 13 of the safety gear 12 via the rope 14. In addition, a braking device 27 having two mutually parallel braking plates 34, 34 is attached to the lever arm 20 at a point near the second end of the lever arm 20, the new rope 15 being fitted to run between these braking plates. From the braking device 27, the new rope 15 is passed to the lower diverting pulley 17 of the speed limiter as stated above. The lever arm 20 is additionally provided with a guide element 36 placed on its side surface facing towards the rope 15 and guide wheel 22 and fitted to guide the rope 15 going downwards so that the rope 15 will not accidentally get between the lever arm 20 and the guide wheel 22.

In addition to the braking plates 34, 35, the braking device 27 has a front plate 27*a* which is disposed at a horizontal distance from the inner braking plate 35. Moreover, compression springs 33 functioning as tensioning elements have been fitted between the front plate 27*a* and the inner braking plate 35 by means of bolts 29 and 32, said springs being adapted to maintain a desired tension of the new rope 15 passing between the braking plates 34, 35, so that the portion of the rope 15 running over the upper rope pulley 11*a* of the speed limiter 11 is at a sufficient tension to allow safety gear action during the supply of new rope 15. Thus, the tension of the rope 15 in the braking device 27 is adjusted to a value such that the friction on the upper rope pulley 11*a* of the speed limiter 11 is sufficient for activation of the safety gear 12 if necessary even during a jump-lift. For the adjustment of the compressive force of the compression springs 33, the braking device 27 is provided with adjusting screws 31. The braking device 27 is further provided with threaded bolts serving as locking elements 30, by means of which the rope 15 is locked to be immovable relative to the braking device 27 during normal operation of the elevator.

Figure 7:
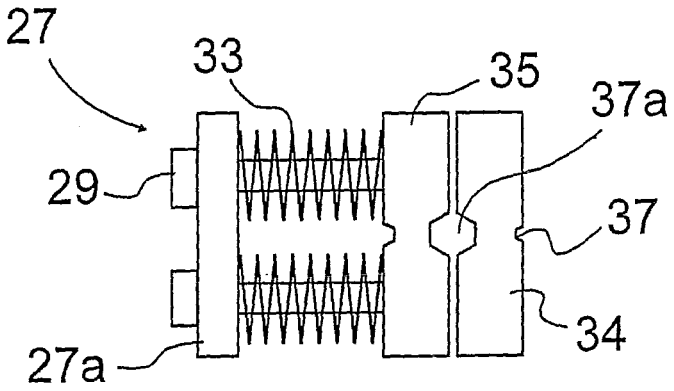
Figure 8:
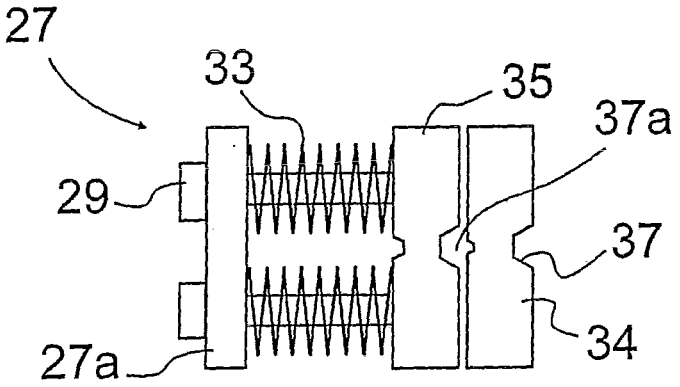
Figure 9:
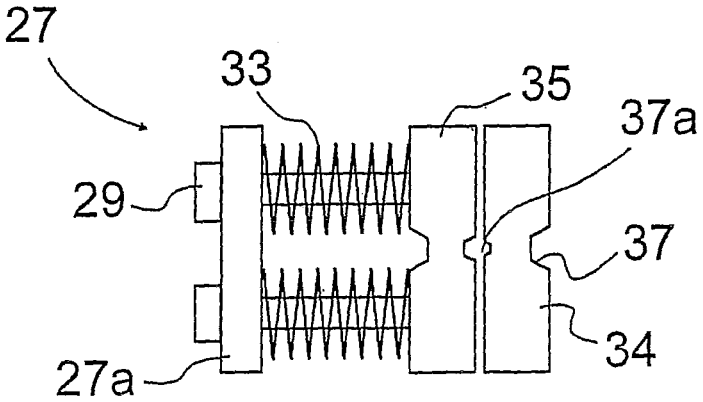

FIGS. 7-9 present different structural alternatives for the braking device 27, which allow the same structural components of the braking device to be used to accommodate speed limiter ropes 15 of different thicknesses in the arrangement of the invention. The two larger side surfaces of the braking plates 34, 35 have grooves 37 extending longitudinally at the middle of the braking plates. When the braking plates 34, 35 are placed opposite to each other, the grooves 37 form between the braking plates a space 37*a*, in which the new rope 15 can be placed. By varying the size of the grooves 37, it is possible to vary the size of the space 37*a* and therefore the thickness of the rope accommodable in it.

The braking plates 34, 35 may be mutually identical in respect of the grooves 37 e.g. so that the two braking plates have a large groove of the same size on one side and likewise a small groove of mutually the same size on the other side. Thus, by suitably dimensioning the grooves 37, it is possible to use ropes of three different thicknesses between the braking plates 34, 35, because the braking plates can be placed opposite to each other so that the space 37*a* formed by the grooves may be of three different sizes, i.e. 1) large groove against large groove, 2) large groove against small groove, and 3) small groove against small groove.

In FIGS. 7-9, there is presented a solution still more versatile than the above-described solution. In the solution illustrated by these figures, the braking plates 34, 35 are not mutually identical with respect to the grooves 37, but the braking plates 34, 35 are provided with grooves 37 of three different sizes in all. Braking plate 34 has a large groove on its first side and a small groove on the other side. Similarly, braking plate 35 has a medium-sized groove on its first side and a large groove on the other side. Via suitable dimensioning of the grooves 37, grooves thus formed can form spaces 37*a* of four different sizes which can accommodate ropes 15 of four different thicknesses.

It is obvious to a person skilled in the art that different embodiments of the invention are not exclusively limited to the examples described above, but that they may be varied within the scope of the claims presented below. Thus, for example, the structure and placement of the rope feed device may vary from the above description. The rope feed device may be placed e.g. on an external wall of the elevator car instead of on the top of the elevator car.

It is also obvious to a person skilled in the art that the rope of the speed limiter may be passed from the speed limiter to the lever of the safety gear of the elevator car in a manner differing from the above description.

It is further obvious to a skilled person that e.g. the structure and placement of the braking device may differ from those described above. It is likewise obvious to the skilled person that the placement of the reel supplying new speed limiter rope may vary from that described above.

It is obvious to the person skilled in the art that the invention is not limited to the embodiments described above, in which the invention has been described by way of example, but that many variations and different embodiments of the invention are possible within the scope of the inventive concept defined in the claims presented below.

The invention claimed is:

1. An arrangement in supply of a rope to a speed limiter of an elevator as a speed limiter rope, said elevator comprising at least a hoisting machine and an elevator car suspended to be supported by the hoisting machine and fitted to move along guide rails in an elevator shaft, and said speed limiter comprising at least an upper rope pulley placed in conjunction with the speed limiter, over which pulley the speed limiter rope has been fitted to run, and a diverting pulley which is placed in the lower part of the shaft and under which the speed limiter rope has been fitted to run, and a safety gear, to which the rope is secured, wherein the arrangement comprises at least a braking device for braking the rope supplied to the speed limiter, said braking device being fitted to maintain a sufficient tension of at least a portion of the rope which runs over the rope pulley to permit gripping during the supply of the rope with a jump-lift of a machine room where the hoisting machine is located, wherein the braking device has at least two mutually parallel braking plates, and the rope has been fitted to run between the two mutually parallel braking plates, wherein the arrangement comprises a rope feed device, on which the braking device is disposed and which rope feed device has been fitted to be movable with the elevator car, and wherein the rope feed device comprises a lever arm hinged to be movable in a vertical plane, to a free end of which are fastened both a first end of the rope coming from the upper rope pulley of the speed limiter and the rope going from the rope feed device to the safety gear.

2. The arrangement according to claim 1, wherein that, as the rope is being supplied to the speed limiter, the rope has been fitted to run via the braking device and under the diverting pulley in the lower part of the elevator shaft and further from the diverting pulley over the upper speed limiter pulley to act on the safety gear of the elevator.

3. The arrangement according to claim 2, wherein the braking device has tensioning elements provided with adjustment of compressive force and arranged to maintain a desired tension of the new rope passing through the braking device.

4. The arrangement according to claim 2, wherein the braking device has locking elements for locking the new rope so as to keep it immovable relative to the braking device during normal operation of the elevator.

5. The arrangement according to claim 1, wherein the braking device has tensioning elements provided with adjustment of compressive force and arranged to maintain a desired tension of the rope passing through the braking device.

6. The arrangement according to claim 5, wherein the braking device has locking elements for locking the new rope so as to keep it immovable relative to the braking device during normal operation of the elevator.

7. The arrangement according to claim 1, wherein the braking device has locking elements for locking the rope so as to keep it immovable relative to the braking device during normal operation of the elevator.

8. The arrangement according to claim 1, wherein it has been adapted to supply new rope to the speed limiter by moving the elevator car upwards.

9. The arrangement according to claim 1, wherein it has been adapted to supply new rope during the jump-lift from a reel placed on the elevator car so that the new rope going through the rope feed device is passed through the braking device, in which braking device a tension of the rope is adjusted to be such that a friction on the upper rope pulley of the speed limiter is sufficient to activate the safety gear if necessary during the jump-lift.

* * * * *